US007034259B1

(12) United States Patent
Lokar et al.

(10) Patent No.: US 7,034,259 B1
(45) Date of Patent: Apr. 25, 2006

(54) SELF-REGULATING HEATER ASSEMBLY AND METHOD OF MANUFACTURING SAME

(75) Inventors: Raymond Lokar, Eastlake, OH (US); Richard Lokar, Orwell, OH (US); Nathan Lucas, Mantua, OH (US)

(73) Assignee: Tom Richards, Inc., Mentor, OH (US)

( * ) Notice: Subject to any disclaimer, the term of this patent is extended or adjusted under 35 U.S.C. 154(b) by 0 days.

(21) Appl. No.: 11/026,416

(22) Filed: Dec. 30, 2004

(51) Int. Cl.
*H05B 3/44* (2006.01)

(52) U.S. Cl. ..... 219/544; 219/542; 219/538

(58) Field of Classification Search ..... None
See application file for complete search history.

(56) References Cited

U.S. PATENT DOCUMENTS

| | | | |
|---|---|---|---|
| 3,564,199 | A | 2/1971 | Blaha |
| 3,584,189 | A | 6/1971 | Marcoux |
| 3,748,439 | A | 7/1973 | Ting et al. |
| 3,749,879 | A | 7/1973 | Armstrong |
| 3,885,129 | A | 5/1975 | Fabricius |
| 3,940,591 | A | 2/1976 | Ting |
| 4,045,763 | A | 8/1977 | Miyamoto et al. |
| 4,147,927 | A | 4/1979 | Pirotte |
| 4,492,947 | A | 1/1985 | Staats et al. |
| 4,822,980 | A | 4/1989 | Carbone et al. |
| 4,972,067 | A | 11/1990 | Lokar et al. |
| 5,598,502 | A | 1/1997 | Takahashi et al. |
| 6,075,806 | A | 6/2000 | Wittle et al. |
| 6,285,005 | B1 | 9/2001 | Aakalu et al. |
| 6,350,969 | B1 | 2/2002 | Rothchild |
| 6,541,743 | B1 | 4/2003 | Chen |

*Primary Examiner*—Thor S. Campbell
(74) *Attorney, Agent, or Firm*—Fay, Sharpe, Fagan, Minnich & McKee, LLP

(57) ABSTRACT

A self-regulating positive temperature coefficient (PTC) heater assembly and a method of manufacturing the heater assembly are disclosed. The PTC heater assembly includes at least one PTC heating element and a pair of spaced electrodes. Each electrode includes a first side, the first sides of the pair of electrodes being spaced from one another, wherein the at least one PTC element is located between, supported by and energized by the pair of electrodes. The at least one PTC element is oriented approximately transverse to a longitudinal axis of the pair of spaced electrodes. An electrically insulative and thermally conductive interface pad is interposed between and contiguous to the first side of at least one of the pair of electrodes and a wall of the PTC element. A pair of power leads, one being connected to each of the pair of electrodes, energizes the pair of electrodes.

22 Claims, 7 Drawing Sheets

SELF-REGULATING HEATER ASSEMBLY AND METHOD OF MANUFACTURING SAME

BACKGROUND OF THE INVENTION

The present invention relates generally to a heater assembly and more particularly to a self-regulating heater assembly which comprises a positive temperature coefficient heating device and is adapted for use in hostile environments.

Self-regulating heater assemblies are well known in the art. A positive temperature coefficient (PTC) heating device is a semiconductor which has an electrical resistance that is temperature sensitive. The electrical resistance of the PTC device varies proportionately with temperature. PTC devices are generally available as ceramics or polymers and are well known for use in temperature sensors, current limiters and heaters. Their usefulness as a heater is particularly attractive due to the fact that a self regulating heater can be constructed. When a current is passed through a PTC device, it produces heat by virtue of the internal resistance of the PTC device and the resultant current is similar to that of other resistance heaters except that at a certain predetermined temperature (curie point or autostabilizing temperature), the resistance begins to increase virtually exponentially, causing the power to decrease. Thus, the PTC device autostabilizes at a particular predetermined temperature. The temperature at which the PTC device autostabilizes will vary depending upon the specific PTC device. The autostabilizing temperature feature of the PTC device is useful because it can be established at a temperature which is below the ignition temperature of the heater environment or the melt point of a chemically resistant fluoropolymer coating.

PTC self-regulating heaters have not been particularly successful in the prior art when used in hostile environments such as in the chemical processing industry. In such hostile environments, strong oxidizers, free halogen ions and strong reducing acids contribute to the degradation of PTC heater assemblies.

An elongated self-regulating PTC heater assembly which includes a single heating section comprising a plurality of PTC heating elements located between a pair of electrodes is disclosed in U.S. Pat. No. 4,972,067. However, this design employs a heat shrink tube, to hold the electrodes in contact with the surfaces of the PTC heating element, inside a metallic sheath together with an outer polymeric sheath. As a result, the thickness of the plastic layers may produce sufficient thermal resistance to increase the temperature of the PTC heater assembly above its autostabilizing temperature, rendering it ineffective as a heating device. Also, this design employs only a single column of PTC elements between a pair of electrodes that run the entire length of the PTC heater assembly, thus limiting the amount of heat which can be generated.

Accordingly, it has been considered desirable to develop an improved self-regulating heater assembly which would overcome the foregoing difficulties and others while providing better and more advantageous overall results.

BRIEF DESCRIPTION OF THE INVENTION

In an exemplary embodiment of the invention, a self-regulating heater assembly is provided.

More particularly, in accordance with this aspect of the present invention, a self-regulating heater assembly comprises at least one positive temperature coefficient (PTC) heating element and a pair of spaced electrodes. Each electrode includes a first side, the first sides of the pair of electrodes being spaced from one another, wherein the at least one PTC element is located between, supported by and energized by the pair of electrodes. The at least one PTC element is oriented approximately transverse to a longitudinal axis of the pair of spaced electrodes. An electrically insulative and thermally conductive interface pad is interposed between and contiguous to the first side of at least one of the pair of electrodes and a wall of the PTC element. A pair of power leads, one being connected to each of the pair of electrodes, energizes the pair of electrodes.

In accordance with another aspect of the present invention, a self-regulating heater assembly comprises a plurality of spaced heating sections. Each heating section comprises at least one PTC heating element and a pair of spaced apart electrodes which supports and energizes the at least one PTC element. Each electrode has a generally planar first side and a second side. An electrically and thermally conductive interface pad is in contact with a surface of the at least one PTC element and is disposed between the at least one PTC element and each of the pair of electrodes. An electrically insulative and thermally conductive segment spacing member is positioned between adjacent ones of the plurality of heating sections. A pair of power leads, one being connected to each of the pair of electrodes of each of the plurality of spaced heating sections, energizes each of the heating sections.

In accordance with yet another aspect of the present invention, an elongated heater assembly comprises a plurality of longitudinally spaced heating sections. Each heating section comprises a pair of spaced electrodes and a plurality of PTC elements secured between the pair of spaced electrodes. Each PTC element is smaller in height than is a height of the pair of spaced electrodes and is in electrical and thermal contact with the pair of electrodes. An electrically insulative and thermally conductive segment spacing member is positioned between adjacent ones of the plurality of spaced heating sections. A metallic sheath encases the plurality of spaced heating sections. An electrically insulative and thermally conductive fill material is located between the metallic sheath and each of the plurality of heating sections. The heating section further includes a pair of spaced power leads, wherein a respective one of the pair of power leads is connected to a respective one of the pair of spaced electrodes of each heating section.

In accordance with still yet another aspect of the present invention, a self-regulating heater assembly comprises a plurality PTC heating elements and a plurality of electrodes which energizes the plurality of PTC elements. Each of the plurality of PTC elements is mounted between and connected to a pair of spaced electrodes of the plurality of electrodes. A plurality of electrically insulative spacer members is secured to at least some of the plurality of electrodes. A metallic sheath surrounds the plurality of electrodes. The metallic sheath compresses the plurality of insulative spacer members toward at least some of the plurality of electrodes.

In accordance with still yet another aspect of the present invention, a method of manufacturing a self-regulating heater comprises the steps of providing a plurality of PTC heating elements and a plurality of electrodes which energizes the plurality of PTC elements. Each electrode includes at least one bore that receives at least one associated power lead which energizes the electrode. At least one PTC element is positioned between each pair of the plurality of electrodes at an angle to a longitudinal axis of the pair of electrodes. The pair of electrodes is compressed against the at least one PTC element to establish and maintain substantially uniform electrical contact therebetween.

Still other aspects of the invention will become apparent from a reading and understanding of the detailed description of the embodiments hereinbelow.

BRIEF DESCRIPTION OF THE DRAWINGS

The present invention may take physical form in certain parts and arrangements of parts, embodiments of which will be described in detail in this specification and illustrated in the accompanying drawings which form a part of the invention.

DETAILED DESCRIPTION OF THE PREFERRED EMBODIMENTS

Figure 1:
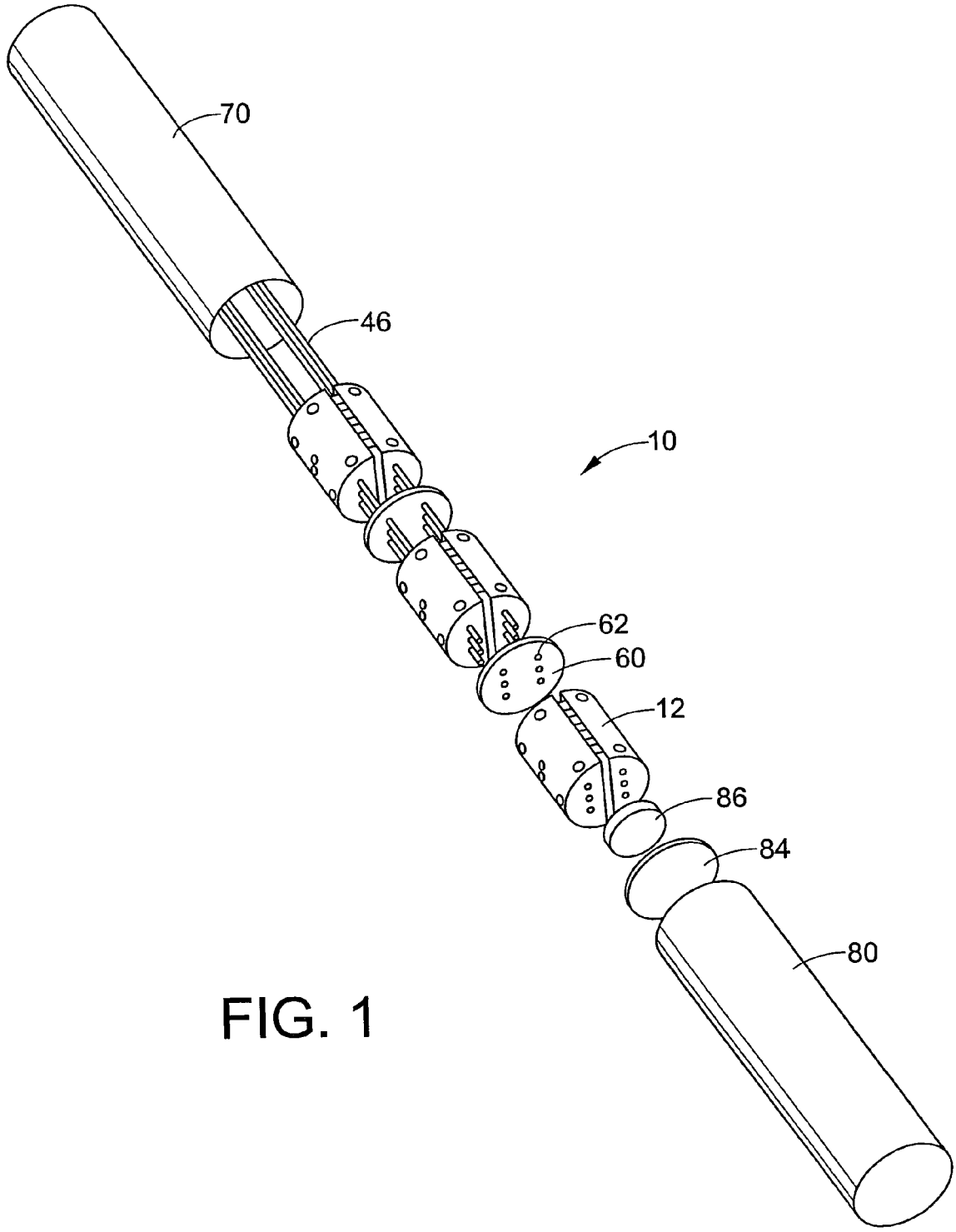
FIG. 1 is an exploded perspective view of a self-regulating heater assembly according to a first embodiment of the present invention.

Referring now to the drawings, wherein the showings illustrate the preferred embodiments of the invention only and are not intended to limit same, FIG. 1 shows an exploded view of a self-regulating heater assembly 10 in accordance with a first embodiment of the present invention. In this embodiment, the self-regulating heater assembly 10 is oriented approximately along a vertical axis. Therefore, the terms "upper" and "lower" will be used to describe certain structures of the self-regulating heater assembly 10. It should be recognized, however, that if the self-regulating heater assembly 10 were to be oriented along a horizontal axis, the terms "upper" and "lower" would lose their respective meaning.

Figure 2:
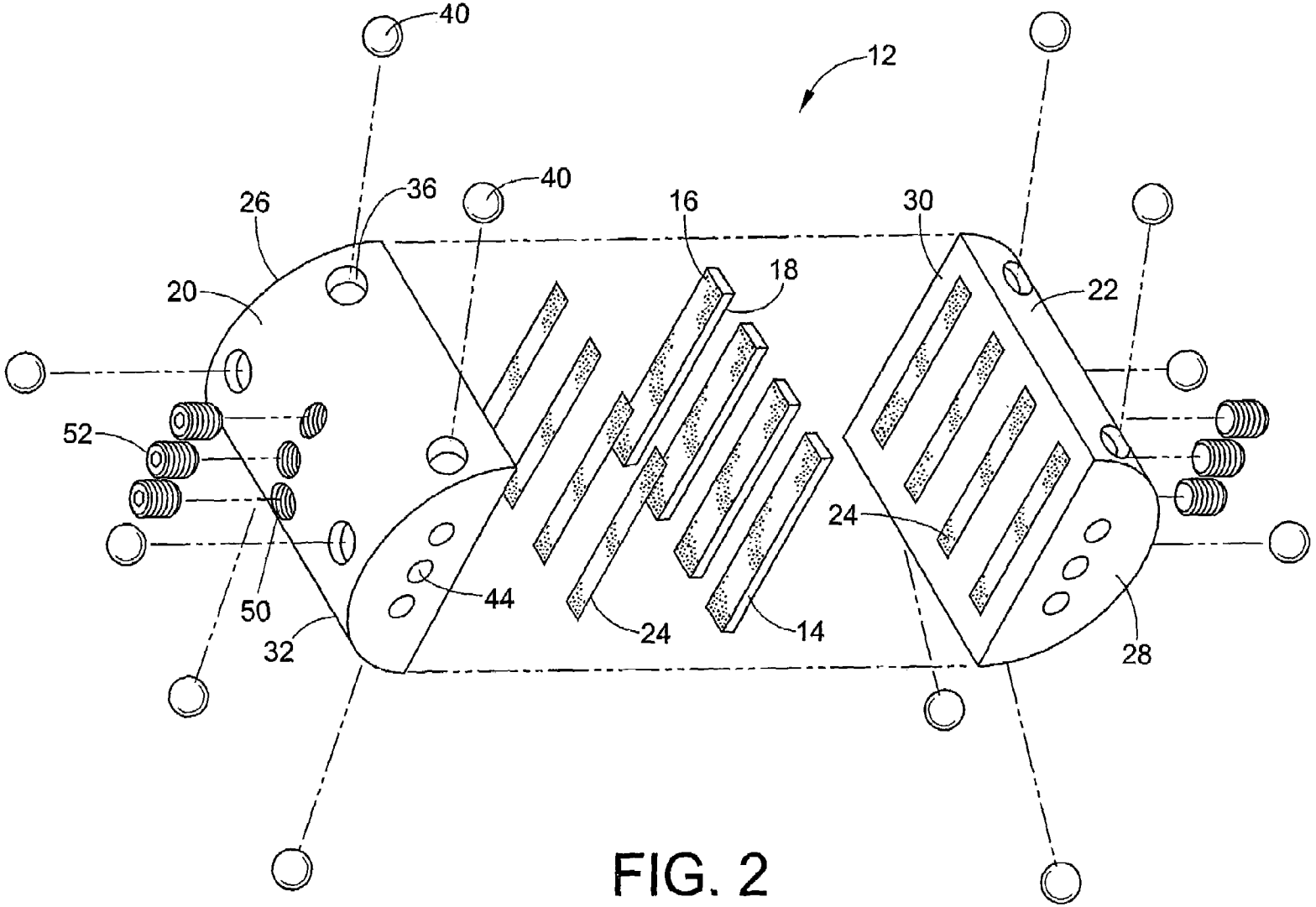
FIG. 2 is an enlarged exploded perspective view of a heating section of the self-regulating heater assembly of FIG. 1.

The self-regulating heater assembly 10 comprises a plurality of spaced heating sections 12. With reference to FIG. 2, each heating section includes at least one positive temperature coefficient (PTC) heating element 14. The PTC element can be rectangular in shape and include a pair of opposed generally parallel planar surfaces 16 and 18. Of course, other geometric shapes for the PTC elements are also contemplated, such as, for example, disc-shaped elements.

The heating section 12 also includes a pair of low electrical resistance current conducting electrodes 20 and 22 for energizing the PTC element. As is evident from FIG. 2, a length of each electrode is larger than a width of the PTC element 14. This is why four spaced PTC elements 14 can be accommodated between a pair of electrodes 20, 22. Of course, more or less than four PTC elements 14 (e.g., six or three) could be used for each heating section 12, if so desired. It should also be appreciated that the PTC elements 14 can contact each other depending on the configuration of the PTC elements and the media being heated. In the embodiment disclosed, the PTC elements are spaced from each other by about 0.48 inches (1.2 cm).

Generally, the pair of electrodes 20, 22 has a length of approximately two inches. Electrodes of approximately this length typically do not warp excessively as the temperature of the PTC elements increases to a predetermined autostabilizing temperature. Of course, the electrodes can be longer or shorter if desired. However, if the electrodes are too long, they can warp upon heating by the PTC elements to the extent that the PTC elements can separate from the electrodes. On the other hand, if less PTC elements are employed to prevent excessive warpage on longer electrodes in a heating section, the section will generate only a lesser amount of heat. Thus, electrodes on the order of about two inches (5.1 cm) in length have been found useful for providing a good amount of heat without excessive warpage, that might lead to failure of the heating section.

As shown in FIG. 2, the electrodes 20, 22 can each be in the form of a half cylinder. However, the electrodes could take different shapes than the half cylinder shapes illustrated, if so desired. For example, the electrodes could have a hexagonal or rectangular shape in cross-section. More generally, while an approximately cylindrical heater assembly is disclosed herein, it should be appreciated that a heater according to the present invention could also take the form of a plate or a box if desired, so long as each heater section produces sufficient heat without excess warpage, and so long as the heater can be successfully sheathed with a protective sheath.

With continued reference to FIG. 2, each heating section further includes an electrically conductive and stress relieving interface pad, film or coating 24 contacting the surfaces 16 and 18 of each PTC element 14. The interface pad 24 can be constructed of a graphite film or compound that would provide good electrical and heat transfer to the surrounding environment from the PTC elements 14 when the PTC elements are energized. The interface pad 24 fills thermally insulating voids, relieves tensile stresses generated by varying expansion rates of dissimilar materials and provides for good lubricity to the planar surfaces 16 and 18 of the PTC elements 14. It should be appreciated by one skilled in the art that other known electrically and thermally conductive interface pads, films or coatings could also be used.

The pair of electrodes 20 and 22 is preferably made from a suitable metallic material. Two such materials are an electrical grade copper and aluminum alloys. Each electrode includes an upper surface 26, a lower surface 28, a first side 30 and a second side 32. The first side can be generally planar and the second side can have a general arcuate contour. However, it can be appreciated by one skilled in the art that the second side of each electrode can have other configurations depending on the end use of the self-regulating heater assembly 10. The first side 30 of each electrode is contiguous with a portion of at least one of the interface pad 24 and one of the planar surfaces 16 and 18 of each PTC element 14. As shown in FIG. 2, each PTC element 14 and each interface pad 24 can be oriented approximately traverse to a longitudinal axis of each electrode 20, 22. The second sides 32 of the pair of electrodes 20, 22 can cooperate to define a substantially circular cross-sectional configuration for the self-regulating heater assembly 10. The several PTC elements 14 can also be oriented at other angles in relation to the longitudinal axis of the heater element 12. It has been found, however, that PTC elements oriented approximately normal to the longitudinal axes of the electrodes perform marginally better.

Figure 6A:
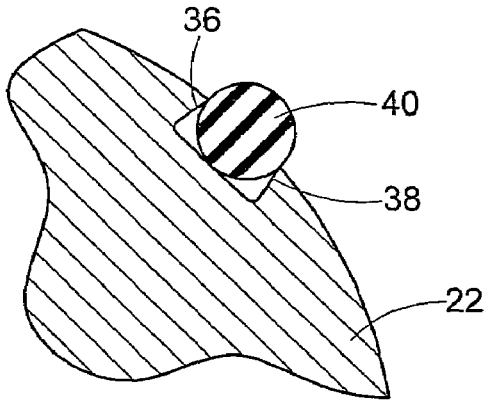
FIG. 6A is an enlarged cross-sectional view of a portion of the heater assembly of FIG. 4.

With continued reference to FIG. 2, the second sides 32 of the pair of electrodes 20, 22 can include at least one cavity 36 for securing at least one electrically insulative spacer member 40. As shown in FIG. 6A, the cavity can include a flat bottom. The cavity 36 is dimensioned to receive a portion of the spacer member 40. Thus, a portion of the spacer member projects outwardly from the cavity. The cavity 36 can further include at least one detent 38 which stakes the spacer member in the cavity. In one embodiment, the second side 32 of each electrode includes six cavities for accommodating six spacer members. Of course, more or less than six cavities and six spacer members could be employed.

Figure 4:
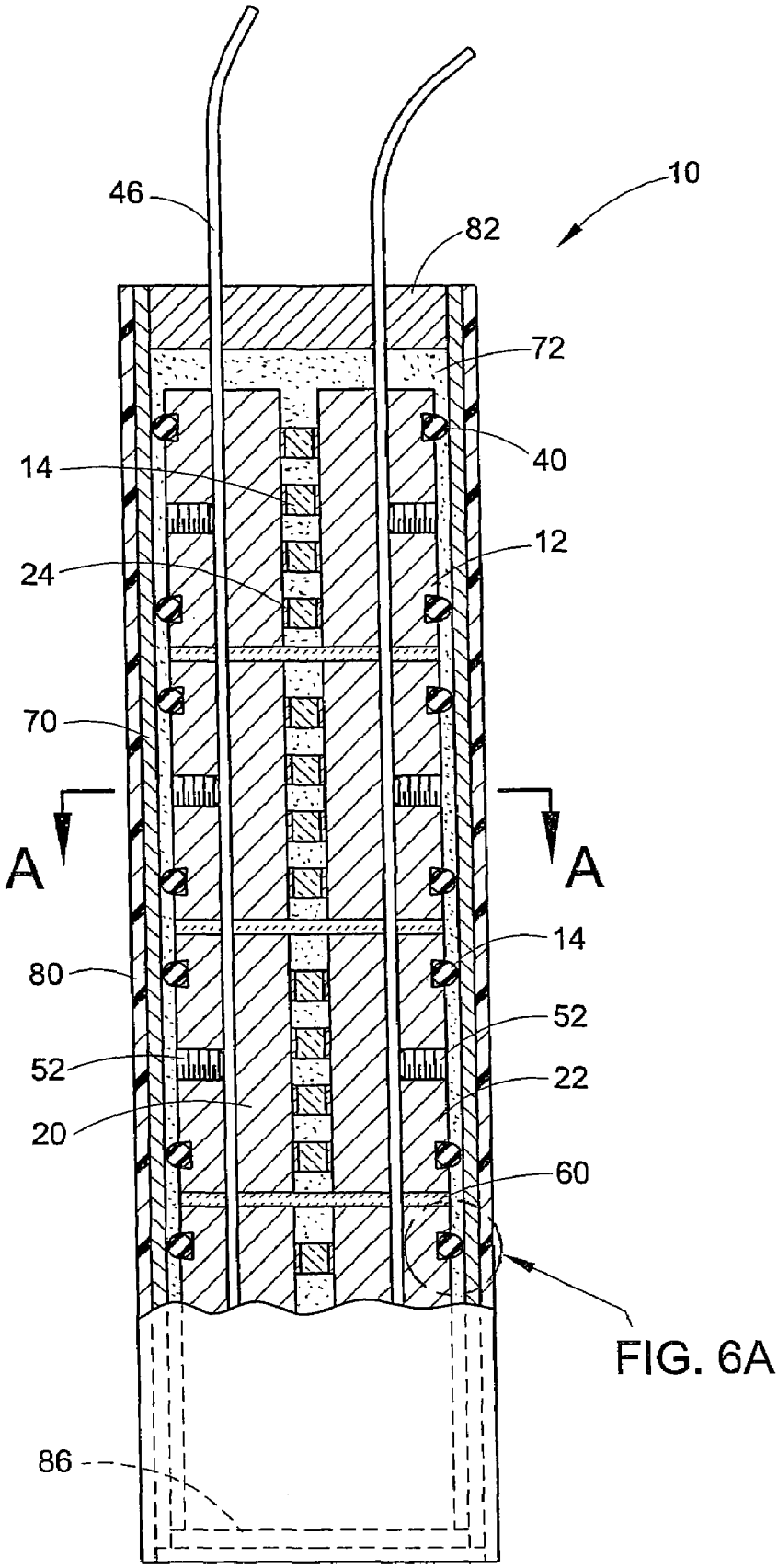
FIG. 4 is a cross-sectional view of the self-regulating heater assembly of FIG. 3.
Figure 5:
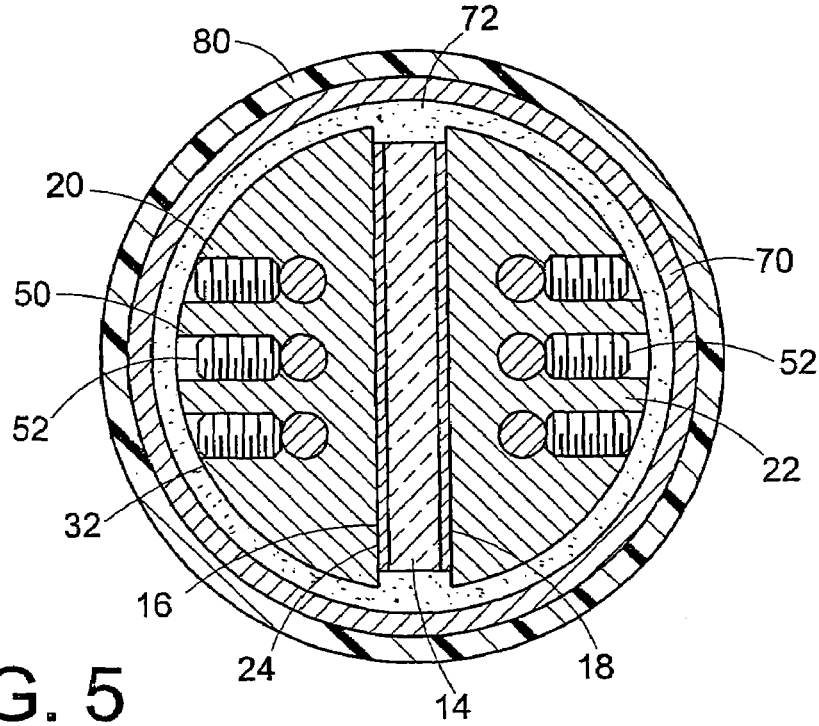
FIG. 5 is a cross-sectional view of the self-regulating heater assembly of FIG. 4 taken along the line A—A of FIG. 4.

As shown in FIGS. 4 and 5, the spacer member 40 compresses the planar first side 30 of each electrode 20, 22 against its interface pads 24 and one of the planar surfaces 16 and 18 of each PTC element 14 to establish substantially uniform electrical contact therebetween. The spacer member 40 can have a general round contour. However, it should be appreciated that there can be embodiments of the present invention that utilize spacer members having different contours.

With continued reference to FIGS. 1 and 2, defined on the upper and lower surfaces 26 and 28 of the pair of electrodes 20 and 22 is at least one bore 44 that extends parallel to a longitudinal axis of the electrode and through it. The bore receives a power lead 46 for energizing the pair of electrodes. In this embodiment, each electrode includes three bores 44 for receiving three power leads 46. Thus, a three-phase Delta configuration is shown. Of course, more or less than three power leads could be used for energizing each electrode. For example, if single phase power was provided to the electrodes, three power leads would not be necessary.

The second sides 32 of the pair of electrodes 20 and 22 further include at least one threaded aperture 50 for receiving a set screw 52. As shown in FIG. 4, the set screw threadingly engages the aperture until the set screw contacts the power lead. This contact ensures an electrical connection of a power line with the electrode.

To assemble the self-regulating heater 10, the PTC elements 14 are first secured to the pair of electrodes 20 and 22 in such a manner that the electrically and thermally conductive interface pads 24 are interposed between and contiguous to the PTC elements and the pair of electrodes. Specifically, the interface pads 24 are adhered to the first sides 30 of each electrode 20, 22. The PTC elements 14 are then adhered to the interface pads. Particularly, the planar surface 16 of the PTC element is adhered to the interface pad secured to the first electrode 20 and the planar surface 18 of the same PTC element is adhered to a corresponding interface pad secured to the second electrode 22. In one embodiment, a known silicon based adhesive is used to secure the interface pads 24 to the electrodes 20, 22 and the PTC elements 14 to the interface pads. PTC heating elements are known and are available from Advanced Thermal Products, Inc. of St. Mary's, Pa., PTC Ceramics of Krems, Austria and Hiel Corporation of Kyoungki-Do, Korea.

The spacer member 40 is then inserted into the cavity 36 disposed about each second side 32 of the pair of electrodes 20, 22. With reference again to FIG. 1, a segment spacing member 60 is positioned between the lower surfaces 28 of one pair of electrodes and the upper surfaces 26 of an adjacent pair of electrodes of each heating section 12. The segment spacing member can be formed from an electrically insulative and thermally conductive material. It can be flexible for enabling the self-regulating heater assembly 10 to be bent at the segment spacer member. The segment spacing member 60 includes at least one aperture 62 which is aligned with the bore 44 of each electrode 20 and 22 for receiving the respective power lead 46 for each electrode. The segment spacing member can be made of a magnesium silicate material such as steatite which has good electrical resistance properties, which are retained at high temperatures, along with moderate mechanical strength and temperature resistance.

The assembled heating sections 12 are then inserted in a sheath 70 which holds the pair of electrodes 20 and 22 in contact with the interface pad 24 and the planar surfaces 16 and 18 of the PTC element 14. The sheath 70 simplifies the construction of the self-regulating heater assembly 10 by exerting pressure on the spacer members 40 which in turn positively locate the pair of electrodes 20, 22, the interface pads 24 and the PTC element 14.

Not only does sheath 70 maintain substantially uniform contact pressure between the PTC element 14 and the pair of electrodes 20, 22, it also acts to enhance the thermal characteristics of the self-regulating heater assembly 10. The sheath transfers heat from the PTC element 14 to the environment when the PTC element is energized. The sheath 70 further protects the PTC element from hostile environments and physical damage. Moreover, the sheath 70 serves as an electrical conductor and ground path circuit for the self-regulating heater assembly 10 if short-circuiting occurs. To this end, a ground conductor (not shown) can be connected to sheath 70 to serve as a ground path circuit to protect operating personnel in the event of an electrical fault condition.

Figure 3:
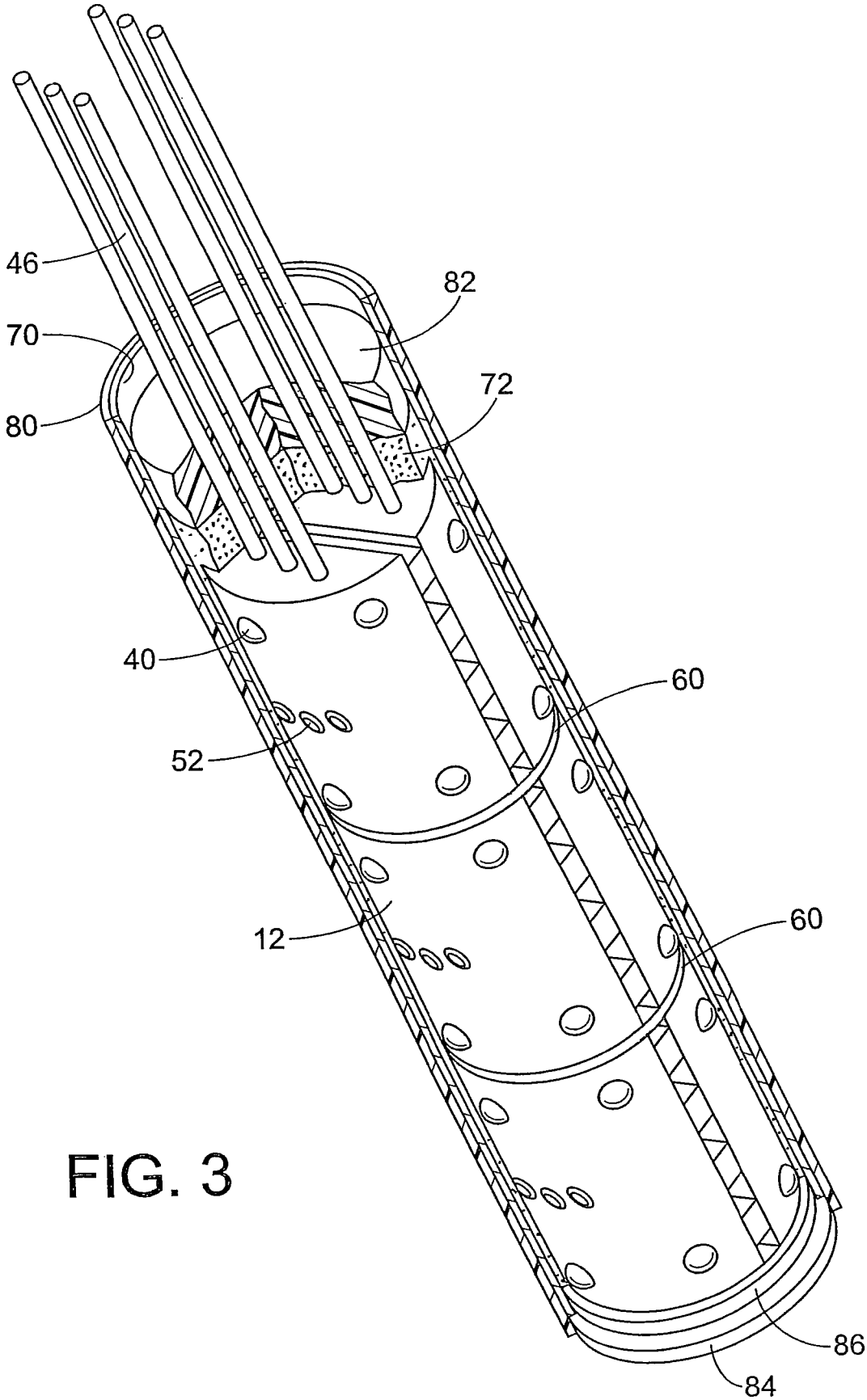
FIG. 3 is an enlarged perspective view, partially broken away, of the self-regulating heater assembly of FIG. 1 in an assembled condition.

With reference to FIG. 3, the assembled heating sections 12 are held in place by the spacer members 40. The spacer members transfer radial inward forces from the sheath 70 to the electrically conductive interface pads 24 and each PTC element 14. This not only maintains substantially uniform contact pressure between the PTC element 14, interface pad 24 and the pair of electrodes 20, 22, but it also acts to enhance the thermal characteristics of the self-regulating heater assembly 10. Further, the interface pads 24 reduce any air voids in the self-regulating heater assembly which would decrease the thermal efficiency of the self-regulating heater assembly and provides stress relief of any thermal expansion differences between dissimilar materials.

If desired, the sheath 70 can be filled with an electrically insulative and thermally conductive fill member 72 to fill any remaining voids. The fill member 72 can be formed of magnesium or zirconium oxide, though any suitable electrically insulative and thermally conductive material could be used. The fill member 72 is disposed about at least a portion of the second sides 32 of the pair of electrodes 20 and 22, a portion of the first sides 30 thereof, and the side edges and end edges of each PTC element 14. The fill member also protects the PTC element and radiates heat away from the PTC element when the PTC element is energized.

With continued reference to FIGS. 1 and 3, a protective sleeve 80 can surround the sheath 70 to further protect the self-regulating heater assembly 10 from hostile environments. The sleeve 80 can be a heavy walled sleeve and can be made from a chemical and heat resistant polymer material such as a fluorocarbon polymer, an ethylenated fluorocarbon polymer, a chlorinated fluorocarbon polymer, an ethylenated/chlorinated fluorocarbon polymer, a polyvinyl fluorocarbon polymer, or a perfluoroalkoxy polymer.

The power leads 46 are fed through the bores 44 extending longitudinally through each of the pair of electrodes 20 and 22. The power leads energize the pair of electrodes. As shown in FIGS. 4 and 5, to ensure an electrical connection on the electrodes, the set screws 52 are threaded in the threaded apertures 50 of the second sides 32 of the pair of electrodes 20 and 22 until each set screw contacts the respective power lead. The power leads can be in parallel or Delta configurations for single or polyphase operation. When power is provided on the power leads 46, the pair of electrodes 20, 22 will be energized and a circuit will be completed between electrodes via the electrically conductive interface pads 24 and the PTC element 14. As current is passed through the PTC element, the PTC element generates heat by virtue of its internal resistance. The heat is transferred via the conductive interface pad 24, the pair of electrodes 20, 22, the fill member 72, the sheath 70 and the protective sleeve 80 to the environment, in which self-regulated heater assembly 10 is disposed.

With reference to FIGS. 3 and 4, a heat resistant potting compound 82 can be placed into an upper portion of the self-regulating heater assembly 10 to seal the upper portion of the self-regulating heater assembly against the fluid in which the heater assembly is immersed. As shown in FIG. 1, a plug or end cap 84 made from the same material as the sleeve 80 is provided at a lower portion of the self-regulating heater assembly 10 to seal the lower portion. A bottom insulator 86 can be positioned between the lower surfaces 28 of the electrodes 20, 22 and an upper surface of the end cap 84. The bottom insulator can be made of the same magnesium silicate material as the segment spacing member 60.

Figure 6B:
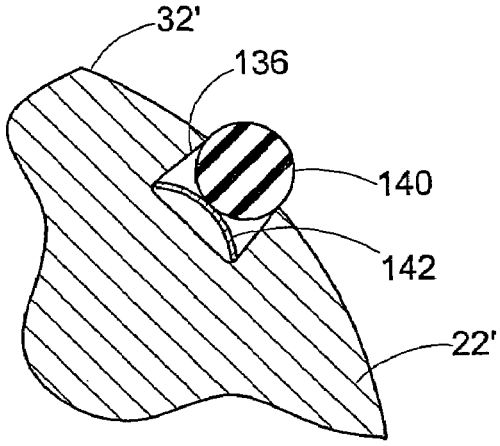
FIG. 6B is a cross-sectional view of a self-regulating heater assembly according to a second embodiment of the present invention.
Figure 7:
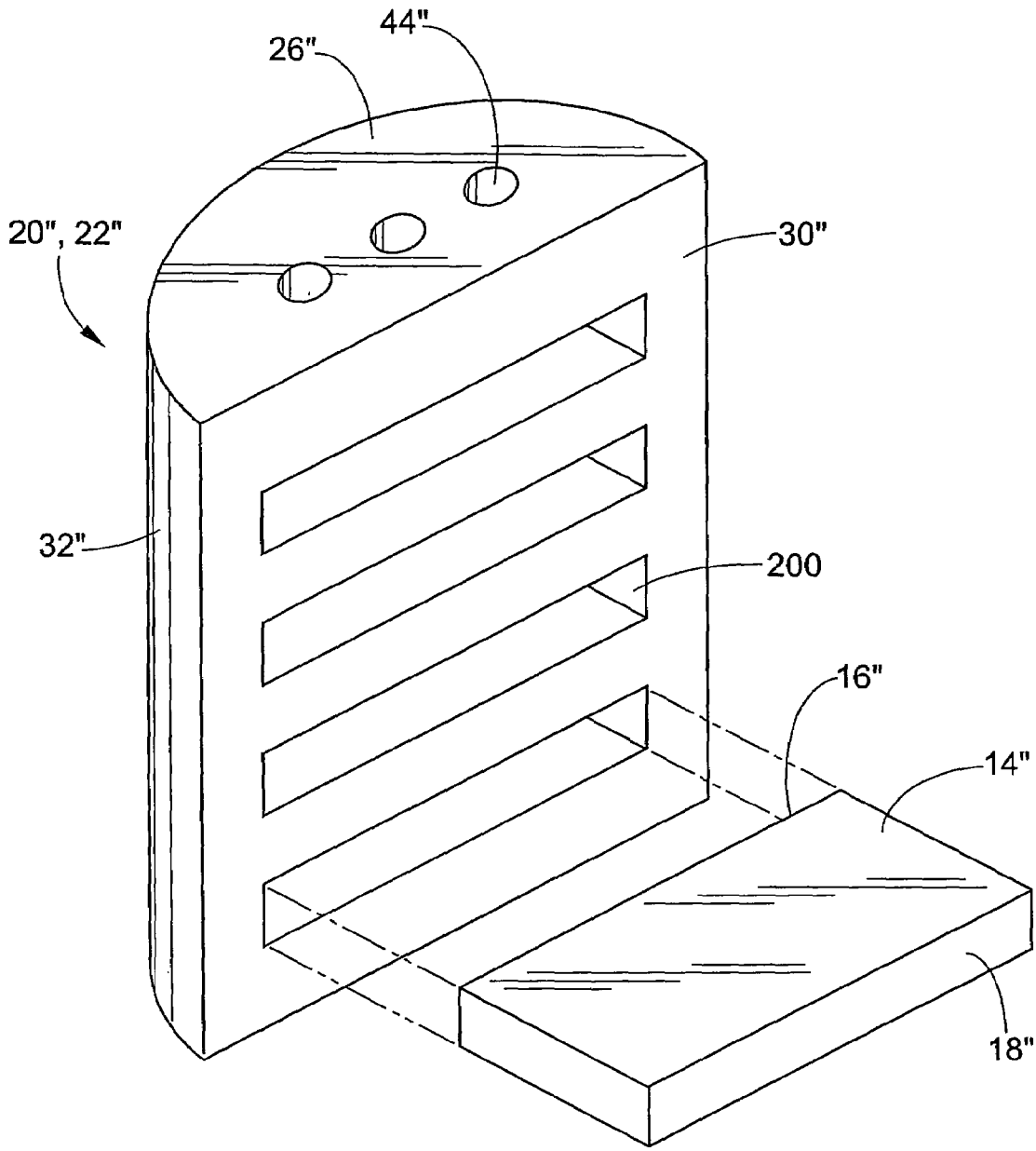
FIG. 7 is an exploded perspective view of a heater assembly according to a third embodiment of the present invention.

Similar to the aforementioned embodiment, two additional embodiments are shown in FIGS. 6B and 7. Since most of the structure and function is substantially identical, reference numerals with a single primed suffix (') refer to like components (e.g., electrode is referred to by reference numeral 22'), and new numerals identify new components in the additional embodiment of FIG. 6B. Likewise, reference numerals with a double primed (") suffix refer to like components (e.g., PTC element is referred to by reference numeral 14") in the still additional embodiment of FIG. 7, and new numerals identify new components.

With reference to FIG. 6B, the second sides 32' of the pair of electrodes 20', 22' include at least one cavity 136 for releasably securing at least one electrically insulative spacer member 140. The spacer member 140 has a general round contour and can be spring loaded. To this end, a spring washer 142 is releasably secured in the cavity 136 to bias the spacer member 140 outwardly.

With reference to FIG. 7, the planar first sides 30" of the pair of electrodes 20", 22" can include at least one slot 200 dimensioned to releasably secure a portion of a PTC element 14". In this embodiment, the planar first sides include four slots for accommodating four PTC elements. Of course, more or less than four slots could be employed for each heating section.

To assemble the self-regulating heater of FIG. 7, electrically and thermally conductive interface pads (not shown) are interposed between and contiguous to the PTC elements 14" and the pair of electrodes 20" and 22". The PTC elements 14' are then releasably secured in the slots 200 of the electrodes. Specifically, the interface pads are adhered to the planar surfaces 16" and 18" of the PTC elements. A first portion of each PTC element is positioned in the slot 200 of the planar first side 30" of a first electrode 20" and a second portion of the same PTC element is positioned in a corresponding slot of the planar first side 30" of the second electrode 22".

Figure 8:
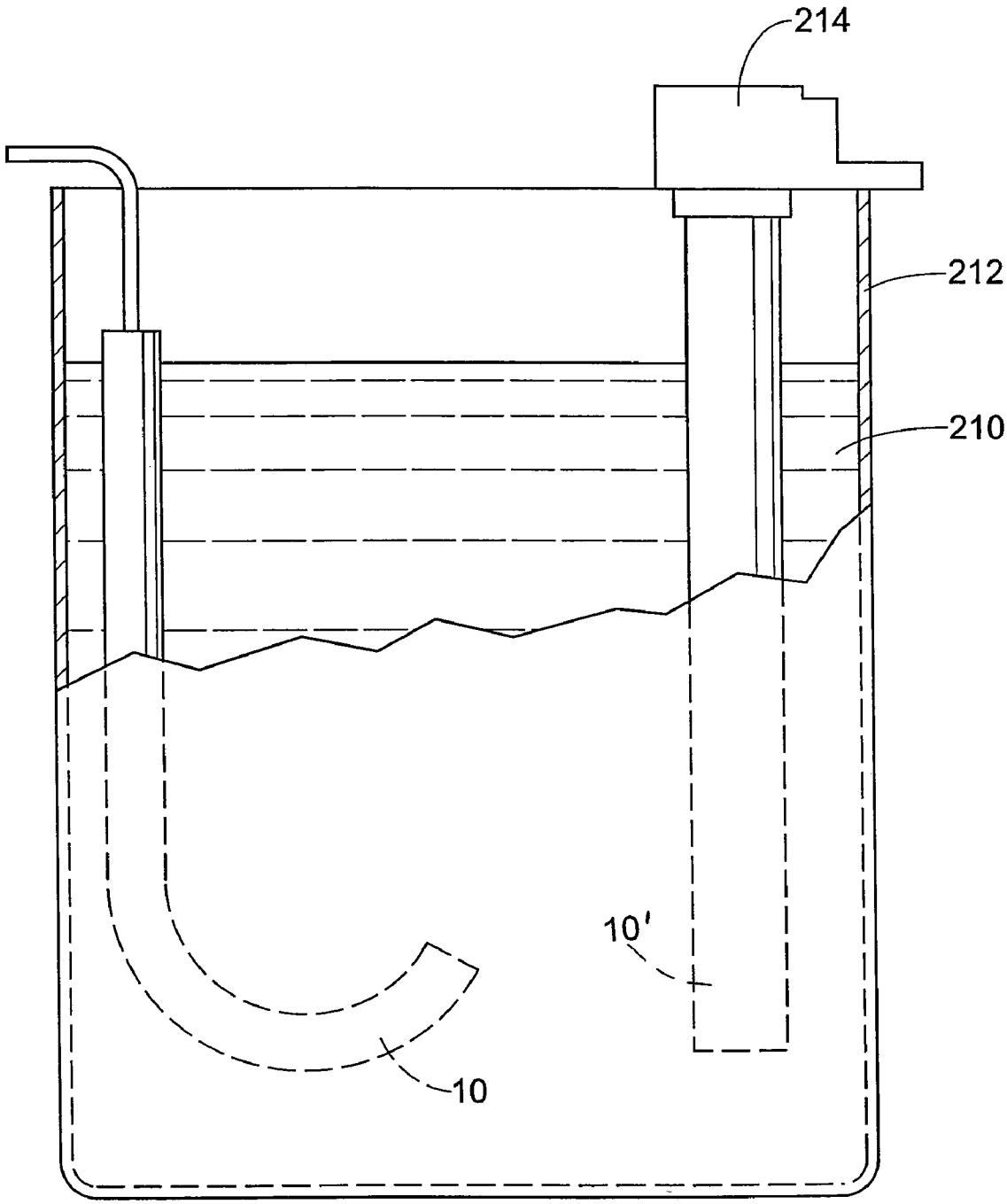
FIG. 8 is a schematic illustration showing the self-regulating heater assembly of FIG. 1 utilized for heating a tank of liquid, which can be corrosive.

With reference to FIG. 8, the self-regulated heater assembly 10 can transfer heat to a liquid 210 in a tank 212 to effect heating of the liquid. As is disclosed by the phantom lines in FIG. 8, the self-regulated heater assembly 10 can be straight (see 10'), bent and fabricated into various shapes and sizes to accommodate various desired configurations. Although FIG. 8 shows two different configurations for the heater assembly 10, 10', it should be appreciated that only one heater assembly may be necessary to transfer heat to the liquid 210 in the tank 212. The heater assembly 10' can also include a housing 214 secured on a top portion of the heater assembly for housing the power leads.

The present invention provides a self-regulating heater assembly 10 which is particularly suited for use in hostile environments where the self-regulating effect of the PTC element 14 occurs at a temperature which is below the ignition temperature of the hostile environment. In the present construction, the PTC element was permitted a maximum temperature of 500° F. The combination of the electrically conductive interface pad 24, the pair of electrodes 20, 22, the fill member 72, the sheath 70 and the protective sleeve 80 minimizes temperature build-up at the PTC element while providing good heat conductivity from the PTC element to the environment such as liquid 210.

From the foregoing, it should be apparent that a new and improved self-regulating heater assembly 10 and a method of manufacturing the self-regulating heater assembly have been disclosed. The self-regulating heater assembly includes at least one PTC element 14, and the pair of electrodes 20, 22 for energizing the PTC element. The first side 30 of each electrode is contiguous to and in contact with at least one of the interface pads 24 and one of the planar surfaces 16, 18 of the PTC element 14. Further, the first side of each electrode can include at least one slot 200 for releasably securing a portion of each PTC element. Electrically insulative spacer members 40 are disposed on the second sides 32 of the pair of electrodes 20, 22. The spacer members 40 assist in the assembly of the self-regulated heater 10 by holding the PTC element 14, interface pads 24 and pair of electrodes 20, 22 in place while being inserted in the sheath 70. The pressure from the spacer members 40 on the sheath provides uniform and substantial electrical and thermal contact between the pair of electrodes, interface pad and the PTC element. A protective heat resistant and preferably a chemical and heat resistant sleeve 80 can surround the sheath 70 to provide further protection to the self-regulated heater assembly 10. The sheath 70 can be filled with an electrically insulative and thermally conductive fill member 72 to fill any remaining voids.

The exemplary embodiments of the present invention have been described with reference to several preferred embodiments. Obviously, modifications and alterations will occur to others upon reading and understanding the preceding detailed description. It is intended that the invention not be limited to the embodiments described. Rather, the present invention should be construed as including all modifications and alterations which come within the scope of the appended claims or the equivalents thereof.

The invention claimed is:

1. A self-regulating heater assembly comprising:

at least one positive temperature coefficient (PTC) heating element;

a pair of spaced electrodes, each electrode including a first side, said first sides of said pair of electrodes being spaced from one another, wherein said at least one PTC element is located between, supported by and energized by said pair of electrodes, and said at least one PTC element is oriented approximately transverse to a longitudinal axis of said pair of spaced electrodes;

an electrically and thermally conductive interface pad interposed between and contiguous to said first side of at least one of said pair of electrodes and a wall of said PTC element;

at least one electrically insulative spacer member for establishing substantially uniform electrical contact between said first side of each electrode and said at least one PTC element; and a first pair of power leads, one power lead being connected to each of said pair of electrodes for energizing said pair of electrodes.

2. The self-regulating heater assembly of claim 1 further comprising an electrically insulative and thermally conductive fill member located between said first sides of said pair of electrodes such that said at least two PTC elements extend through said fill material.

3. The self-regulating heater assembly of claim 1 further comprising:

a sheath surrounding said pair of electrodes; and a protective sleeve surrounding said sheath.

4. The self-regulating heater assembly of claim 3 wherein said at least one electrically insulative spacer member is positioned between said sheath and a second side of each electrode.

5. The self-regulating heater assembly of claim 4 wherein said second side of each electrode includes at least one cavity for accommodating a portion of said at least one insulative spacer member, and wherein said cavity includes at least one detent for securing said at least one insulative spacer member in said cavity.

6. The self-regulating heater assembly of claim 4 wherein said second side of each electrode includes at least one cavity for accommodating a portion of said at least one insulative spacer member, and wherein said cavity includes a biasing member for urging said at least one insulative spacer member outwardly.

7. The self-regulating heater assembly of claim 1 wherein the first side of each electrode includes at least one cavity for accommodating a portion of said PTC element.

8. The self-regulating heater assembly of claim 1 wherein said second side of each electrode includes a threaded aperture for receiving a set screw, said set screw contacting a respective power lead to ensure an electrical connection with said electrode.

9. A self-regulating heater assembly comprising:

a plurality of spaced heating sections, each heating section comprising:

at least one positive temperature coefficient (PTC) heating element, a pair of spaced apart electrodes for supporting and energizing said at least one PTC element, each electrode having a generally planar first side and a second side, and an electrically and thermally conductive interface pad in contact with a surface of said at least one PTC element and disposed between said at least one PTC element and each of said pair of electrodes;

an electrically insulative and thermally conductive segment spacing member positioned between adjacent ones of said plurality of heating sections, and, at least one pair of power leads, one being connected to each of said pair of electrodes of each of said plurality of spaced heating sections for energizing each of said heating sections.

10. The self-regulating heater assembly of claim 9 further comprising an electrically insulative and thermally conductive fill material disposed about a portion of each heater section.

11. The self-regulating heater assembly of claim 9 further comprising:

a metallic sheath encasing said heater assembly; and a protective sleeve surrounding said metallic sheath.

12. The self-regulating heater assembly of claim 11 wherein each heating section further comprises at least one electrically insulative spacer member positioned between each electrode and said metallic sheath.

13. The self-regulating heater assembly of claim 12 wherein said second side of each electrode includes at least one cavity for accommodating a portion of said at least one insulative spacer member.

14. The self-regulating heater assembly of claim 9 wherein said second side of each electrode includes a threaded aperture for receiving a set screw, said set screw contacting said power lead to ensure an electrical connection with said electrode.

15. A method of manufacturing a self-regulating heater comprising the steps of:

providing a plurality of positive temperature coefficient (PTC) heating elements;

providing a plurality of electrodes for energizing said plurality of PTC elements, each electrode including at least one bore for receiving at least one associated power lead for energizing said electrode;

positioning at least one PTC element between each pair of said plurality of electrodes such that a longitudinal axis of said at least one PTC element is oriented at an angle to a longitudinal axis of said pair of electrodes; and, compressing said pair of electrodes against said at least one PTC element to establish and maintain substantially uniform electrical contact therebetween.

16. The method of manufacturing a self-regulating heater assembly of claim 15 further comprising the steps of providing a plurality of electrically and thermally conductive interface pads and interposing each interface pad between a planar first side of each electrode of said pair of electrodes and each PTC element.

17. The method of manufacturing a self-regulating heater assembly of claim 15 further comprising the step of stringing said plurality of electrodes together on the at least one associated power lead.

18. An elongated heater assembly comprising a plurality of longitudinally spaced heating sections, each heating section comprising:

a pair of spaced electrodes, and a plurality of positive temperature coefficient (PTC) heating elements secured between said pair of spaced electrodes, each said PTC element being smaller in height than is a height of said pair of spaced electrodes and being in electrical and thermal contact with said pair of electrodes;

an electrically insulative and thermally conductive segment spacing member positioned between adjacent ones of said plurality of spaced heating sections;

a metallic sheath encasing said plurality of spaced heating sections;

an electrically insulative and thermally conductive fill material located between said metallic sheath and each of said plurality of heating sections; and a pair of spaced power leads, wherein a respective one of said pair of power leads is connected to a respective one of said pair of spaced electrodes of each heating section.

19. The heater assembly of claim 18 wherein each pair of electrodes comprises a planar first side and a second side including a threaded aperture and further comprising a set screw for threading into said aperture until said set screw contacts the respective power lead.

20. The heater assembly of claim 18 further comprising a plurality of spacer members positioned between said metallic sheath and said plurality of heating sections, and at least one socket located on an outer surface of each of said pair of spaced electrodes of each of said plurality of heating sections, each socket accommodating a respective one of said plurality of spacer members.

21. A self-regulating heater assembly comprising:

a plurality of positive temperature coefficient (PTC) heating elements;

a plurality of electrodes for energizing said plurality of PTC elements, wherein each of said plurality of PTC elements is mounted between and connected to a pair of spaced electrodes of said plurality of electrodes;

a plurality of electrically insulative spacer members which are secured to at least some of said plurality of electrodes; and a metallic sheath surrounding said plurality of electrodes, said metallic sheath compressing said plurality of insulative spacer members toward said at least some of said plurality of electrodes.

22. The self-regulating heater assembly of claim 21 further comprising insulative and thermally conductive fill material located between said metallic sheath and said plurality of electrodes.

* * * * *